United States Patent [19]

Sugiyama et al.

[11] Patent Number: 4,854,055

[45] Date of Patent: Aug. 8, 1989

[54] SPORTS SHOE

[75] Inventors: Yasunori Sugiyama, Kobe; Satoru Nakata, Akashi, both of Japan

[73] Assignee: Asics Corporation, Hyogo, Japan

[21] Appl. No.: 92,552

[22] Filed: Sep. 3, 1987

[30] Foreign Application Priority Data

Sep. 5, 1986 [JP] Japan ..... 61-137047

[51] Int. Cl.[4] ..... A43B 5/00; A43B 23/08

[52] U.S. Cl. ..... 36/127; 36/68; 36/69

[58] Field of Search ..... 36/68, 69, 127, 134, 36/114

[56] References Cited

U.S. PATENT DOCUMENTS

| | | | |
|---|---|---|---|
| 2,738,600 | 3/1956 | Shultz | 36/68 |
| 4,255,877 | 3/1981 | Bowerman | 36/68 X |
| 4,484,397 | 11/1984 | Curley, Jr. | 36/68 X |
| 4,506,460 | 3/1985 | Rudy | 36/69 X |
| 4,580,359 | 4/1986 | Kurrash et al. | 36/127 |
| 4,625,435 | 12/1986 | Ueda | 36/68 |
| 4,704,809 | 11/1987 | Ballard | 36/127 |
| 4,766,679 | 8/1988 | Bender | 36/68 X |

FOREIGN PATENT DOCUMENTS

| | | |
|---|---|---|
| 59-11618 | 4/1984 | Japan . |
| 59-20087 | 6/1984 | Japan . |
| 59-23525 | 7/1984 | Japan . |
| 59-27762 | 8/1984 | Japan . |
| 60-38884 | 11/1984 | Japan . |
| 61-18722 | 6/1986 | Japan . |
| 62-59404 | 4/1987 | Japan . |

*Primary Examiner*—James Kee Chi

*Attorney, Agent, or Firm*—David G. Conlin; Ronald I. Eisenstein

[57] ABSTRACT

A sports shoe, provided with a heel counter comprising a heel side wall part having a curved shape, a folded wall part integrally formed along the edge of the heel side wall part as projected inside the curve, and a stationary plate part integrally formed on the side of the heel side wall part opposite to the edge, the heel side lateral wall having one of the lateral wall parts thereof formed as extended farther forward than the other lateral wall part of the heel side wall part on the arch side of foot and the folded wall part being nipped between the upper of the sports shoe and the sold thereof.

3 Claims, 6 Drawing Sheets

SPORTS SHOE

This invention relates to improvements of a sports shoe, particularly a golf shoe.

Most, if not all, conventional golf shoes are similar in overall outward appearance to ordinary men's shoes. The reason for this similarity in shape is believed to reside in the public sentiment which cherishes adherence to the traditional style of shoes. Further, most golf shoes have soles thereof formed of leather or hard polyurethane resin. The reason for choice of this particular material is believed to resides in enabling metallic spikes to be attached fast to the soles. As the result, the golf shoes using such soles have a disadvantage that their soles are deficient in flexibility and capacity for cushioning and the golf shoes themselves are heavy. Thus, they are not necessarily fit for use on golf courses which abound with rises and falls and, therefore, compel golfers to walk a long distance (6 to 7 km on the average).

Ideally, golf shoes are required to be such that the soles thereof abound in flexibility and capacity for cushioning and the golf shoes themselves are light.

As golf shoes of a new type intended to eliminate the drawbacks mentioned above, golf shoes finished in light weight by having the soles thereof made of such a material as foam polyurethane which is light and rich in capacity for cushioning and flexibility have recently appeared in the market. The material for the soles is the same as that which is used for the soles of running shoes and jogging shoes. Though these golf shoes can be so constructed that the soles may abound in flexibility and capacity for cushioning and the golf shoes themselves may weigh light, the golf shoes of this construction are liable to produce unsteady footing in the direction perpendicularly intersecting the foot pressing direction. In other words, the unsteady footing of this nature causes a golfer's axial foot to tremble sideways when the golfer is about to take a shot at a golf ball, particularly at the moment that his golf club impacts on the golf ball, with the adverse result that the tremble will impair the accuracy of the golfer's swing of his golf club and prevent the golfer from taking a steady and accuracy shot at the golf ball. Moreover, the sideways tremble of the golfer's axial foot entails a serious disadvantage that a loss will be caused in the power of swing of his golf club and in the distance of flight of his golf ball.

The inventor has studied the series of motions produced during the course of a swing consisting of address, impact, and follow through, in an effort to elucidate the condition of shift of a golfer's body weight, and more particularly the condition of change of load exerted in the vertical direction, i.e. the direction in which the sole of the golfer's foot is pressed down onto the ground, and in the lateral direction, i.e. the direction perpendicular to the foot-pressing direction mentioned above, and the condition of change of the force (torque) of twist of the sole during the change of load mentioned above. He has consequently learnt that the load is liable to concentrate on the heel part of the golfer's axial foot. The inventor has further found that the concentration of load on the heel part of the golfer's axial foot, particularly at the moment of the impact mentioned above, occurs in the proximity of the outer side of the heel part opposite from the inner side on the arch side of the foot. The inventor has acquired a knowledge that by reinforcing the outer side of the heel part and the immediate vicinity thereof in such a manner as to preclude the concentration of load on the heel part of the axial foot and repress the force (torque) of twist of the sole of the shoe caused by the concentrated load, the golfer wearing the shoes which embody the reinforcement mentioned above is enabled to take a steady and accurate shot at a golf ball and enjoy an increase in the distance of flight of the golf ball.

This invention has been accomplished in view of the true state of affairs mentioned above. An object of this invention is to provide sports shoes which enjoy light weight, ample flexibility, and a large capacity for cushioning and exhibit outstanding stability such that a golfer wearing the sports shoes, on taking a swing at a golf ball, is prevented from otherwise inevitable sideways tremble of his axial foot and enabled to make an accurate shot at the golf ball.

The object mentioned above is accomplished by a sports shoe, provided with a heel counter comprising a heel side wall part having a shape of a curve formed as though along the peripheral edge of a heel, a folded wall part integrally formed along the edge of the heel side wall part as projected inside the curve, and a stationary plate part integrally formed on the side of the aforementioned heel side wall part opposite to the aforementioned edge, which sports shoe is characterized by the fact that the heel side wall part has one of the lateral wall parts thereof formed as extended farther forward than the other lateral wall part of the heel side wall part on the arch side of foot and the folded wall part is nipped between the upper of the sports shoe and the sole thereof.

In the sports shoe of the present invention, the heel counter mentioned above is capable of reinforcing the outer part of the heel part and the immediate vicinity thereof in such a manner as to repress the force (torque) of twist of the sole causable by the concentration of load on the heel part of the axial foot.

A typical sports shoe as a preferred embodiment of this invention will be described below with reference to the accompanying drawings.

Figure 1:
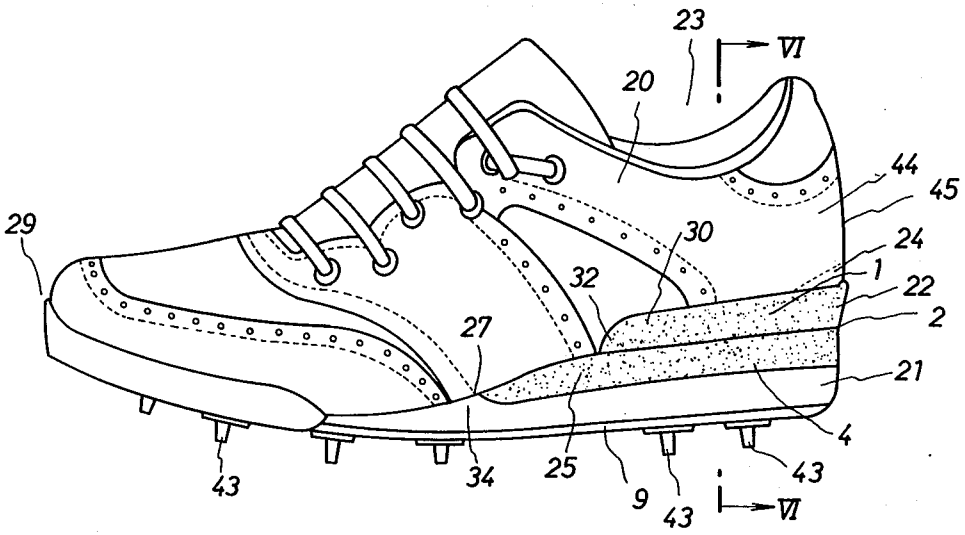
FIG. 1 is a side view of a sports shoe according to the present invention.
Figure 2:
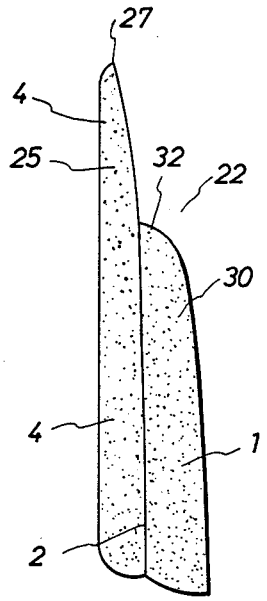
FIG. 2 is a left side view of a heel counter in the sports shoe according to the present invention.

As illustrated in FIG. 1, a sports shoe 23 according to the present invention comprises an upper part 20 constituting the upper portion of the shoe, a sole part 21 constituting the base of the shoe, and a heel counter 22 nipped between the upper part 20 and the sole part 21.

Figure 3:
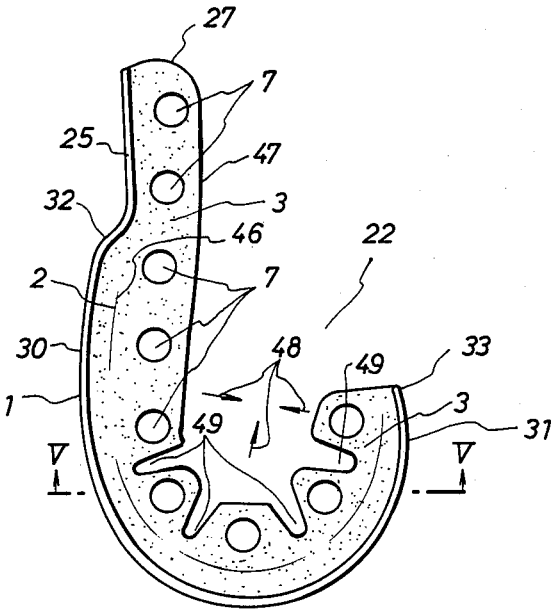
FIG. 3 is a front view of the heel counter of FIG. 2.
Figure 4:
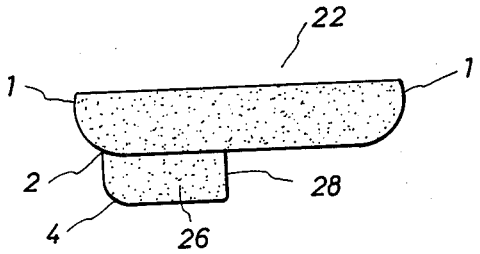
FIG. 4 is a bottom view of the heel counter of FIG. 2.
Figure 8:
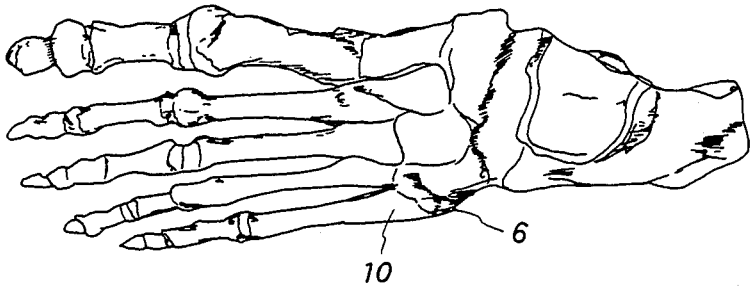
FIG. 8 is an explanatory diagram illustrating the skeleton build of a man's foot.

The heel counter 22, as illustrated in FIGS. 2 through 5, is composed of a heel side wall part 1 in the shape of a curve formed along a peripheral edge 24 of the heel of the sports shoe 23, a folded member 3 as a folded wall part integrally extended from a base edge 2 as an edge part of the heel side wall part 1 toward the inside of the curved shape of the heel side wall part 1, and a stationary plate 4 as a stationary plate part integrally extended from the base edge 2 of the heel side wall part 1 toward the opposite side of the heel side wall part 1. As illustrated in FIG. 3, the heel counter 22 is formed so as to assume an overall shape resembling the shape of a mirror image of the letter J. As a natural consequence, the heel side wall part 1 formed of a curved belt-shaped member assumes an overall shape resembling the shape of the letter J. The heel side wall part 1 is constructed in such a manner that the side wall part 30 which constitutes the longer of the shanks of the letter J is positioned on the side opposite to the side of the arch of the foot in the sports shoe 23. The side wall part 31 which constitutes the shorter of the shanks of the letter J is positioned on the side of the arch of the foot. In the condition in which the heel counter 22 of the foregoing description is fitted in the sports shoe 23 as illustrated in FIG. 1, an end part 32 of the longer side wall part 30 is positioned closer to a toe tip 29 of the sports shoe 23 than an end part 33 of the shorter side wall part 31. More specifically, the heel side wall part 1 is constructed in such a manner that the end part 32 of the longer side wall part 30 will reach the position of a base part 6 of the fifth metatarsal bone 10 of the foot as illustrated in FIG. 8. The term "fifth metatarsal bone 10 of the foot" as used herein means the bone which exists on the outer side of the foot (namely the side part opposite to the inner side part on which there is the arch of the foot). The base part 6 of the fifth metatarsal bone 10 can be felt as a laterally raised portion to a touch given downwardly substantially in the middle of the outer side part of the foot. The fifth metatarsal bone 10 lies forward from the base part 6 in the direction of the toe tip 29. The longer side wall part 30 is formed in a length enough to reach the laterally raised base part 6, namely in such a manner as to extent to the position at which it will contact the base part 6 without exerting pressure thereon. The side wall part 30 is formed in such a manner that the width thereof will gradually decrease in the direction toward the end part 32 thereof. The side wall part 31 is similarly formed on the end part 33 side thereof.

The stationary plate 4 which is formed of a curved belt-shaped member similarly to the heel side wall part 1 assumes a shape resembling the shape of the letter J similarly to the heel side wall part 1. This stationary plate 4 is constructed in such a manner that a side plate part 25 constituting the longer of the shanks of the letter J will be positioned on the side opposite to the side of the arch of the foot of the sports shoe 23 and a side plate part 26 constituting the shorter of the shanks of the letter J will be positioned at a rear end 45 of a heel part 44 of the sports shoe 23. An end part 27 of the longer side plate part 25 is positioned closer to the toe tip 29 of the sports shoe 23 than the end part 32 of the side wall part 30 of the heel side wall part 1 and the end part 28 of the side plate part 26. In other words, the side plate part 25 of the stationary plate 4 is extended forward toward the top tip 29 up to the substantially middle position 34 of the entire length of the sole part 21 of the sports shoe 23 on the outer side part of the foot, which falls farther forward than the end part 28 of the side wall part 30. This middle position 34 of extension, for example, is set so that the sports shoe 23 will be reinforced to repress the force (torque) of twist of the sole of shoe due to the concentration of load on the outer side part of the heel part of the aforementioned axial foot during the series of action, namely the course of a golf swing, particularly at the time of impact. The side plate part 25 is formed in such a manner that the width thereof, in the end part 27 side, will be gradually decreased in the direction toward the end part 27.

Here, the results of an experiment performed with a view to elucidating the condition of shift of body weight of a golfer during the series of motions during the course of the aforementioned swing, more particularly the condition of change of the force (torque) of twist of the sole of shoe due to the change in load to be exerted on the golfer's sole in the vertical direction and the lateral direction will be describe in detail below.

Figure 9:
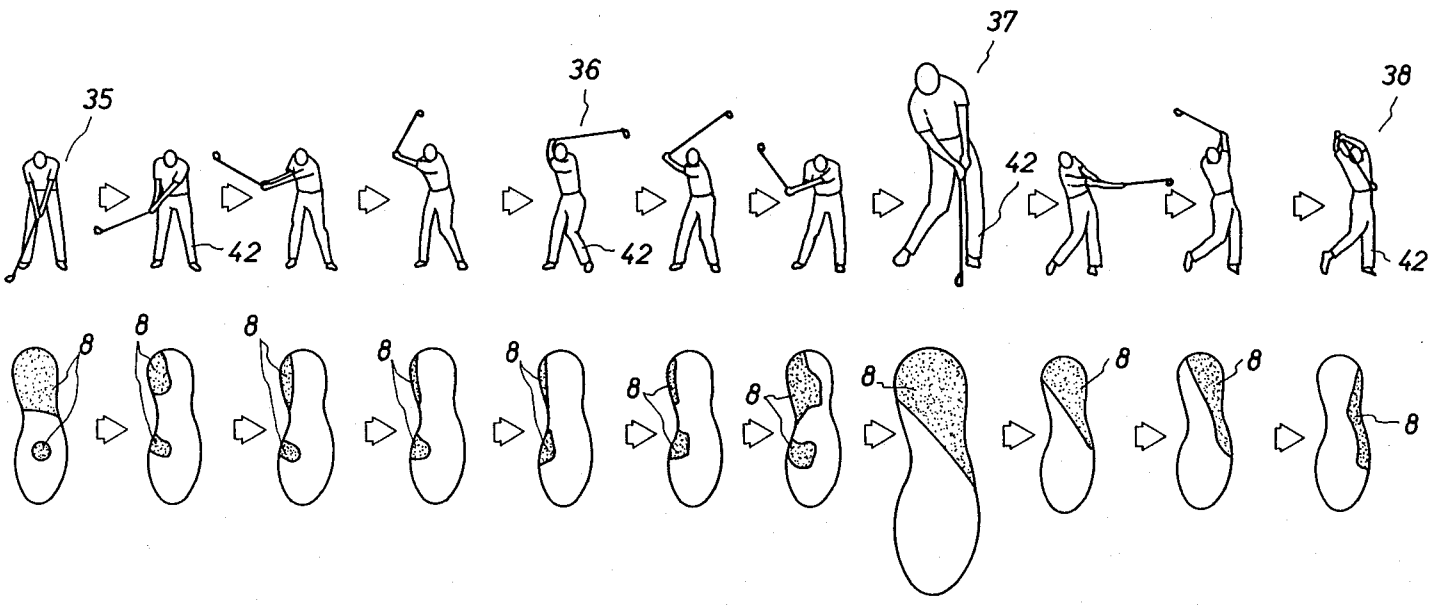
FIG. 9 is an explanatory diagram illustrating the change in the shift of a body weight due to a swing of a golf club.
Figure 10:
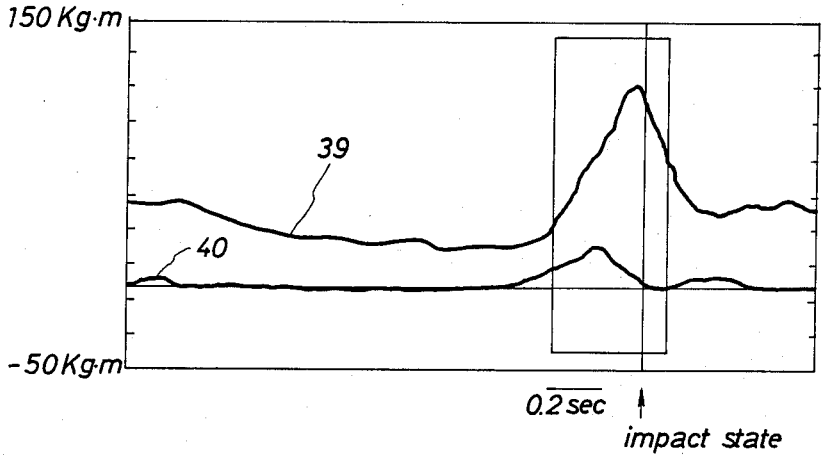
FIG. 10 is an explanatory diagram illustrating the change in the shift of body weight due to a swing of a golf club, in the foot-pressing direction and the lateral direction.
Figure 11:
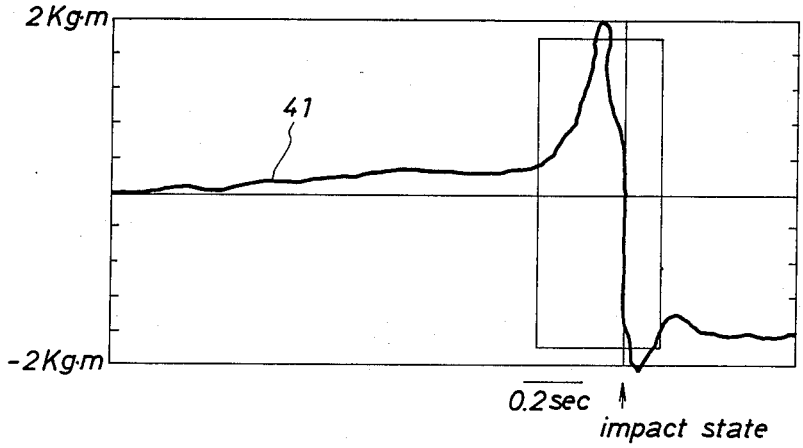
FIG. 11 is an explanatory diagram illustrating the force (torque) of twist caused by the change in the shift of body weight due to a swing of a golf club.

FIG. 9 illustrates the results of an observation continued on the shift condition, namely load concentration position 8, of a golfer's body weight on the sole of the golfer's axial foot 42 in the series of actions made during the course of a swing consisting of address 35, top 36, impact 37, and follow through 38, as viewed upwardly from below. Said position 8 is indicated with a shade. FIG. 10 illustrates the condition of sideways tremble of the golfer's axial foot 42 during the aforementioned course of series of actions, namely the condition of change of the load exerted on the sole of the axial foot 42 in the foot-pressing direction, i.e. the force 39 generated in the vertical direction, and the condition of change of the load exerted in the lateral direction, i.e. the force 40 generated in the horizontal direction. FIG. 11 illustrates the condition of change of the force (torque) 41 exerted on the sole of the golfer's axial foot 42 in the direction of twist during the course of series of actions. As clearly noted from FIGS. 9 through 11, type body weight or load exerted on the inner side part of the axial foot 42 at the state of top 36 is concentrated on the outer side part of the heel of the axial foot 42 at the moment of impact 37. When the golfer has a body weight of 50 kg, for example, the force 39 exerted in the vertical direction amounts to as much as about 100 kg. m. At the state of top 36, the force (torque) 41 in the direction of twist is concentrated as a positive torque of about 2 kg. m on the heel of the axial foot 42. At the moment of impact 37, this force is concentrated as a negative torque of about 2 kg. m on the heel of the axial foot 42. As readily surmised from these result, the sports shoe 23 must be constructed in such a manner that the heel of the axial foot 42, particularly the outer side part of the heel, will be reinforced to withstand the force 40 in the horizontal direction and the force (torque) 41 in the direction of twist. This reinforcement is accomplished by furnishing the sports shoes 23 with the heel counter 22 possessed of the stationary plate 4 which is formed in such a manner that the side plate part 25 will be positioned on the outer side part opposite to the side of the arch of the foot of the sports shoe 23 and the side plate part 26 will be positioned on the rear end of the heel part of the sports shoe 23.

Figure 5:
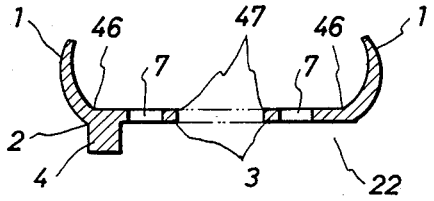
FIG. 5 is a cross section view of the heel counter, taken through FIG. 3 along the line V—V.
Figure 6:
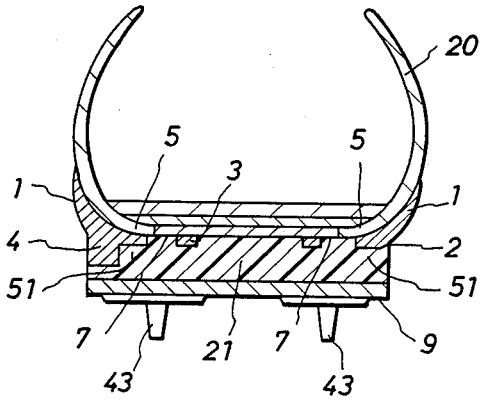
FIG. 6 is a cross section view of the heel counter, taken through FIG. 1 along the line VI—VI.

Further, as illustrated in FIG. 3, FIG. 5 and FIG. 6, a plurality of through holes 7 are formed as spaced substantially equidistantly in the folded member 3 of the heel counter 22. This folded member 3 possesses the shape of a flat plate, one edge 46 of which is integrally connected to the base edge 2 of the heel side wall part 1 and the other edge 47 of which is extended inside the curve of the shape of the letter J, namely in the direction of the arrow 48. The folded member 3 is nipped by edge portion 5 of said upper part 20 and portion 51 of said sole part 21. These through holes 7 are so distributed that six of them will fall on the outer side part, one of them in the heel part 44, and two of them on the inner side part. This arrangement of the through holes may be selected so as to suit particular occasion. The through holes 7 are intended to reinforce the union between the sole 21 of shoe and the heel counter 22 by enabling the material for the sole to flow through the holes 7 when the shoe is integrally molded by injection. The edge 47 of the folded member 3 is provided with four notches 49 in the portion corresponding to the bottom of the letter J in the diagram of FIG. 3. The number of these notches 49 and the arrangement thereof may be freely designed to suit particular occasion.

As a material to form the heel counter 22, it is advantageous to use a hard elastic material capable of repressing the force 40 exerted in the horizontal direction and the force (torque) 41 exerted in the direction of twist. Examples of the hard elastic material answering the description are such elastomers as hard natural rubber, synthetic rubber, styrene-butadiene rubber, isoprene rubber, and ethylene-vinyl acetate. One member or a mixture of two or more members of these elastomers can be used. The material is desired to possess hardness in the range of about 65 degrees to about 80 degrees.

As a material to form the sole 21 of shoe, it is desired to be capable of alleviating the impact exerted upon the golfer's foot when the hoot comes into contact with the ground. Examples of the material useful for the alleviation of the impact are such elastomers as natural rubber, synthetic rubber, isoprene rubber, and ethylene-vinyl acetate copolymer. One member or a mixture of two or more members selected from these elastomers can be used.

The sole is desired to be formed with an elastomer possessing hardness in the range of about 60 degrees to about 65 degrees.

Where metallic spikes 43 are to be attached to the sole 21 as illustrated in FIG. 1 and FIG. 6, there is used a hard outer sole 9 of the kind used on ordinary golf shoes provided with spikes.

Figure 7:
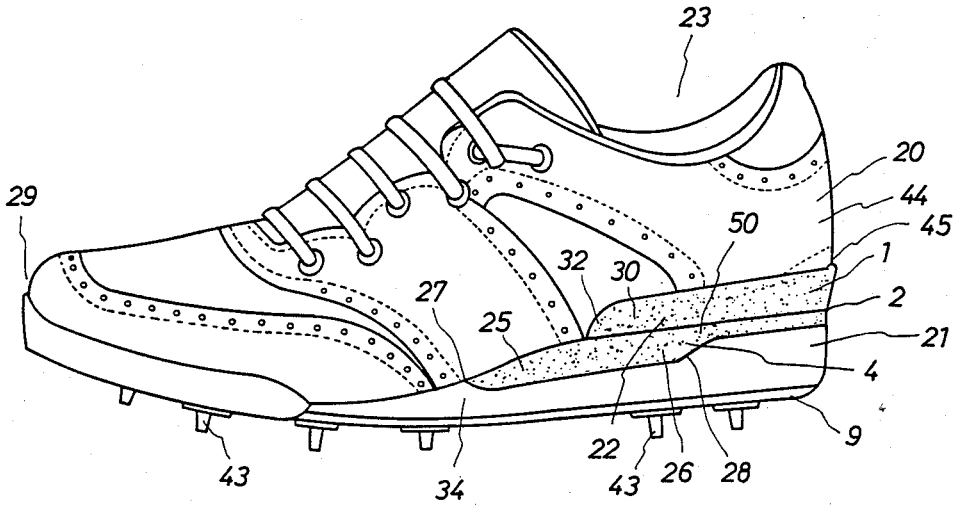
FIG. 7 is a side view illustrating another typical sports shoe according to the present invention.

FIG. 7 illustrated another typical sports shoe 23 incorporating a modified heel counter 22. The end part 28 of the side plate part 26 of the stationary plate 4 in this modified heel counter 22 is not positioned at the rear end 45 of the heel part 44 of the sports shoe 23 but is positioned halfway 50 along the length of the outer side part of the heel part 44 as shown in FIG. 7. The stationary plate 4 of this construction is intended to hold down the force (torque) 41 in the direction of twist with the least possible length of the stationary plate 4. In this case, the sole 21 of shoes is desired to be formed of a material having slightly higher rigidity than the material of the sole 21 in the foregoing embodiment. To be specific, the length and thickness of the stationary plate 4 of this description are determined by the rigidity of the material used for the sole 21 of shoes.

In the construction of this invention described above:

(a) since the heel counter incorporated in the sports shoe is adapted to support concentrically the outer side part of the heel part (the side opposite to the arch side) which is most susceptible of the load of the golfer's body weight in the series of actions during the course of a swing, especially at the moment of the impact state, more specifically to preclude efficiently the sideways tremble of the sole of shoe in the outer direction with the stationary plate and preclude the sideways tremble of the upper part of the sports shoe with the heel side wall part, the golfer's axial foot is steadily supported by the heel counter and the golfer, therefore, is enabled to take a steady shot at a golf ball, and (b) since the sole of the sports shoe is made of a material which is used in running shoes and jogging shoes, and which weights light and excels in capacity for cushioning, the impact exerted on the golfer's foot at the time of contact of the shoe with the ground is alleviated and, therefore, the fatigue suffered to build up in the golfer's foot during a walk of a long distance is lessened.

It should be noted that the present invention can be embodied not merely in golf shoes but also in running shoes and jogging shoes which by nature are required to sue soles of a material characterized by high capacity for cushioning and low rigidity.

What is claimed is:

1. A sports shoe having an upper portion, a sole portion fitted to said upper portion, and a wheel counter fitted to said upper portion and said sole portion, wherein said heel counter comprises:

a folded wall part disposed between said upper portion and said sole portion, said folded wall part consists of two curve formed wall parts extending forwardly along the periphery of said sole portion, one of said wall parts being longer than the other, wherein said longer wall part extends to a longitudinally middle position of said sole portion;

a side wall member projected upwardly from one surface of said folded wall part, said side wall member extending along an outer edge of said folded wall part so as to surround a part of said upper portion; and a stationary plate member having a thickness larger than that of said side wall member, projected downwardly from the other surface of said folded wall part, said stationary plate member extending from a rear end of said sole portion to said longitudinally middle position along the outer edge of said folded wall part.

2. A sports shoe according to claim 1, wherein said side wall member extends at least up to the proximity of the fifth metatarsal bone of a foot at one end thereof.

3. A sports shoe according to claim 1 or 2, wherein said folded wall part is provided with a plurality of through holes formed and substantially equidistantly spaced.

* * * * *